US011499331B2

(12) United States Patent
Abela

(10) Patent No.: US 11,499,331 B2
(45) Date of Patent: Nov. 15, 2022

(54) DUCTILE ANCHOR ATTACHMENT (DAA) MECHANISM

(71) Applicant: Christopher Abela, Rocklin, CA (US)

(72) Inventor: Christopher Abela, Rocklin, CA (US)

( * ) Notice: Subject to any disclaimer, the term of this patent is extended or adjusted under 35 U.S.C. 154(b) by 131 days.

(21) Appl. No.: 16/922,849

(22) Filed: Jul. 7, 2020

(65) Prior Publication Data

US 2021/0095491 A1 Apr. 1, 2021

Related U.S. Application Data

(60) Provisional application No. 62/906,337, filed on Sep. 26, 2019.

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04H 9/0215; E04H 9/0235; E04H 9/0237
See application file for complete search history.

(56) References Cited

U.S. PATENT DOCUMENTS 5,256,016 A * 10/1993 Godfrey ..... F16B 13/065 411/57.1
8,375,652 B2 2/2013 Hiriyur
10,370,844 B2 8/2019 Lomax
2003/0222188 A1* 12/2003 Smelser ..... E04H 9/0237 248/188.91
2005/0005539 A1* 1/2005 Nakamura ..... F16F 7/00 52/167.3
2005/0257490 A1 11/2005 Pryor
2006/0101733 A1* 5/2006 Jen ..... E04H 9/0237 52/167.1
2013/0074440 A1* 3/2013 Black ..... E04H 9/0237 52/704
2014/0311059 A1 10/2014 Pryor

FOREIGN PATENT DOCUMENTS

CN 107386479 A * 11/2017 ..... E04H 9/021
WO WO-9905364 A1 * 2/1999 ..... E01D 19/103
WO WO-0008259 A1 * 2/2000 ..... E01D 19/103
WO WO-2012119763 A1 * 9/2012 ..... F16B 13/065

* cited by examiner

*Primary Examiner* — Babajide A Demuren
(74) *Attorney, Agent, or Firm* — Inventive Law Inc.; Jim H. Salter

(57) ABSTRACT

A ductile anchor attachment (DAA) mechanism is disclosed. Example embodiments are directed to a DAA mechanism having a bottom section configured to connect to an existing anchor; a tapered lower section; a narrowed neck forming a ductile yield mechanism; a tapered upper section; a drilled and untapped top section; and a hollowed interior. Example embodiments are also directed to a DAA mechanism comprising: a headed rebar with a rebar coupler; a rebar segment coupled to the rebar coupler at a first end of the rebar segment; a metal jacket encasing at least a portion of the rebar segment; and a flange connection bracket coupled to the rebar segment at a second end of the rebar segment.

19 Claims, 13 Drawing Sheets

DUCTILE ANCHOR
ATTACHMENT
CAPACITY < 5 KIPS

DAA

PIPE STOCK

USE/PROCESS:
1. DAA IS ATTACHED TO THE ENDS OF ANCHOR HEADS IN A POST-TENSION TRUNNION GIRDER.
2. IF AN ANCHOR FAILS THE ANCHOR WILL IMPACT THE SCREW CAP OF THE DAA.
3. FOLLOWING IMPACT, THE THIN WALL SECTION WILL YIELD WITHOUT DAMAGING THE BOTTOM THREADS.
4. FOLLOWING INCIDENT THE DAA AND ANCHOR ARE REPLACED.

DAA ASSEMBLY COMPONENTS

COLUMN MODIFICATION OPTIONS

DAA ASSEMBLY COMPONENTS

MOMENT FRAME WITH DAA INSTALLED

DUCTILE ANCHOR ATTACHMENT (DAA) MECHANISM

PRIORITY PATENT APPLICATION

This non-provisional patent application draws priority from U.S. provisional patent application Ser. No. 62/906,337; filed Sep. 26, 2019. This present non-provisional patent application draws priority from the referenced patent application. The entire disclosure of the referenced patent application is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2018-2020 Christopher ABELA, All Rights Reserved.

TECHNICAL FIELD

This patent application relates to structural anchors subjected to seismic or lateral forces according to one embodiment, and more specifically to a ductile anchor attachment (DAA) that can provide a stable controlled ductile yield mechanism to dissipate tension forces, and in certain embodiments compression forces, during a seismic or lateral force event while preserving the threads that connect the DAA to an existing anchor.

BACKGROUND

There have long been anchoring devices for securing beams to concrete structural members, and alternatively to perpendicular beams. The concrete anchors have often been large bolts, each inserted straight or bent at a right angle and placed in concrete prior to curing. These bolts are typically heavy and expensive, and concentrate the anchoring load on a single line. Seismic or lateral forces can transfer energy to these anchoring devices and cause rapid, catastrophic, and expensive brittle failures.

According to American Concrete Institute (ACI) building code requirements (ACI 318-14), anchors assigned to certain seismic design categories must satisfy certain requirements, one of which is to develop a ductile yield mechanism. Conventional anchoring devices cannot provide a ductile yield mechanism.

BRIEF DESCRIPTION OF THE DRAWINGS

The various embodiments are illustrated by way of example, and not by way of limitation, in the figures of the accompanying drawings in which.

DETAILED DESCRIPTION

In the following description, for purposes of explanation, numerous specific details are set forth in order to provide a thorough understanding of the various embodiments. It will be evident, however, to one of ordinary skill in the art that the various embodiments may be practiced without these specific details.

In various example embodiments described herein, a ductile anchor attachment (DAA) mechanism is disclosed. Example embodiments are directed to a DAA mechanism, which can attach to a post installed anchor, and is designed to develop and provide a ductile yield mechanism, thus making the example embodiments ideal for either new or existing post installed anchors. The following excerpt from American Concrete Institute (ACI) 318-14 is the specific codified requirement to which the example embodiments are directed: "Ch. 17 Section 17.2.3.4.3b "(b) The anchor or group of anchors shall be designed for the maximum tension that can be transmitted to the anchor or group of anchors based on the development of a ductile yield mechanism in the attachment in tension, flexure, shear, or bearing, or a combination of those conditions, and considering both material over-strength and strain hardening effects for the attachment." The DAA system as disclosed herein is designed to meet current building code guidance related to ACI 318-14 Section 17.2.3.4.3b and Section 17.2.3.4.3d. The DAA system as disclosed herein is also designed to meet American Institute of Steel Construction (AISC) Seismic Design Manual 341-10 Chapter D. Section D.2.6c: Where column bases are designed as moment connections to the foundation, the required flexural strength of column bases that are designated as part of the SFRS, including their attachment to the foundation, shall be the summation of the required connection strength of the steel elements that are connected to the column base as follows: b) For columns, the required flexural strength shall be at least equal to the lesser of the following:

i. 1.1*Ry*Fy*Z (LRFD) or (1.1/1.5)*Ry*Fy*Z (ASD), as applicable, of the column, or ii. the moment calculated using the load combinations of the applicable building code, including the amplified seismic load.

The various example embodiments disclosed herein are designed to enable a stable controlled ductile yield mechanism to form within the DAA mechanism to dissipate tension forces during a seismic or lateral force event while preserving the threads that connect the DAA mechanism to the existing anchor. This allows the DAA mechanism to be conveniently and inexpensively removed and replaced following a seismic or lateral force event or other event producing significant tension forces.

Figure 1:
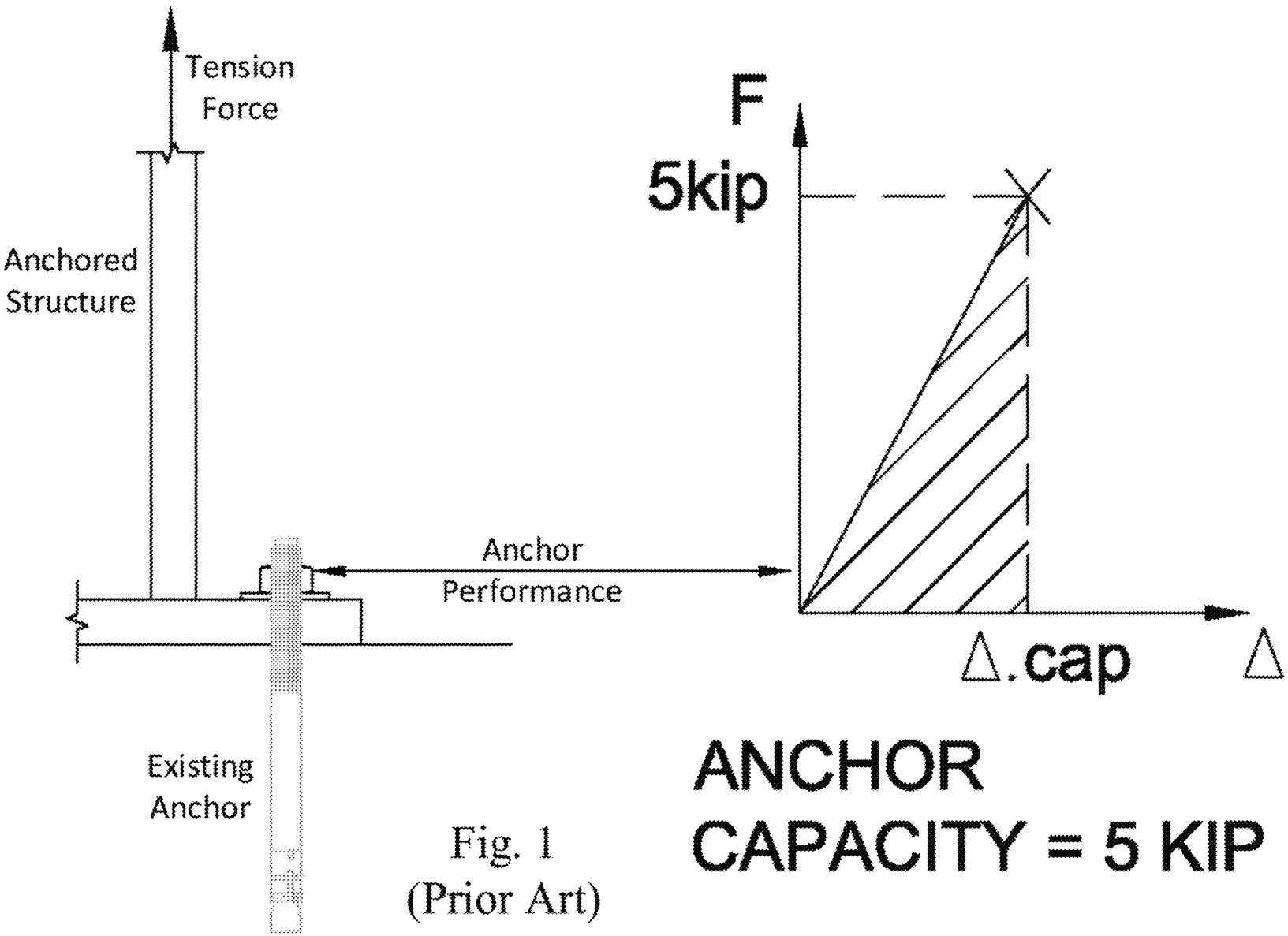
Fig. 1 (Prior Art)
FIG. 1 illustrates a conventional anchor without a ductile yield mechanism showing idealized force deflection performance of the conventional post-installed anchor.

FIG. 1 illustrates a conventional anchor without a ductile yield mechanism showing idealized force deflection performance of the conventional post-installed anchor. The area under the curve shown in FIG. 1 represents work capacity of the system in terms of Joules. Note the linear performance of the conventional anchor without a ductile yield mechanism and assumed brittle failure mode.

Figure 2:
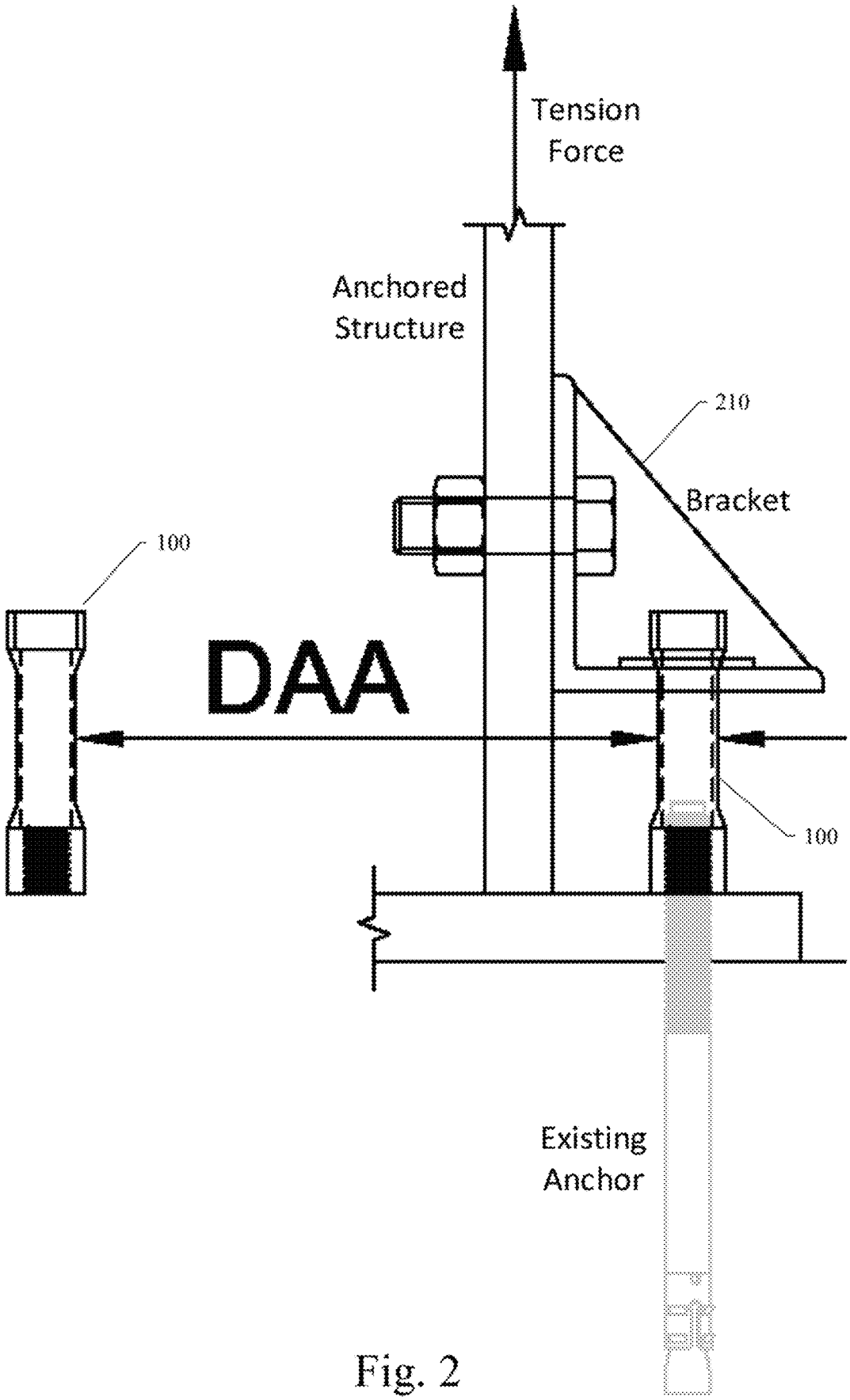
FIG. 2 illustrates an example embodiment of a ductile anchor attachment (DAA) mechanism attached to an anchored structure.

FIG. 2 illustrates an example embodiment of a DAA mechanism 100, the structure and fabrication of which is described in more detail below.

Figure 3:
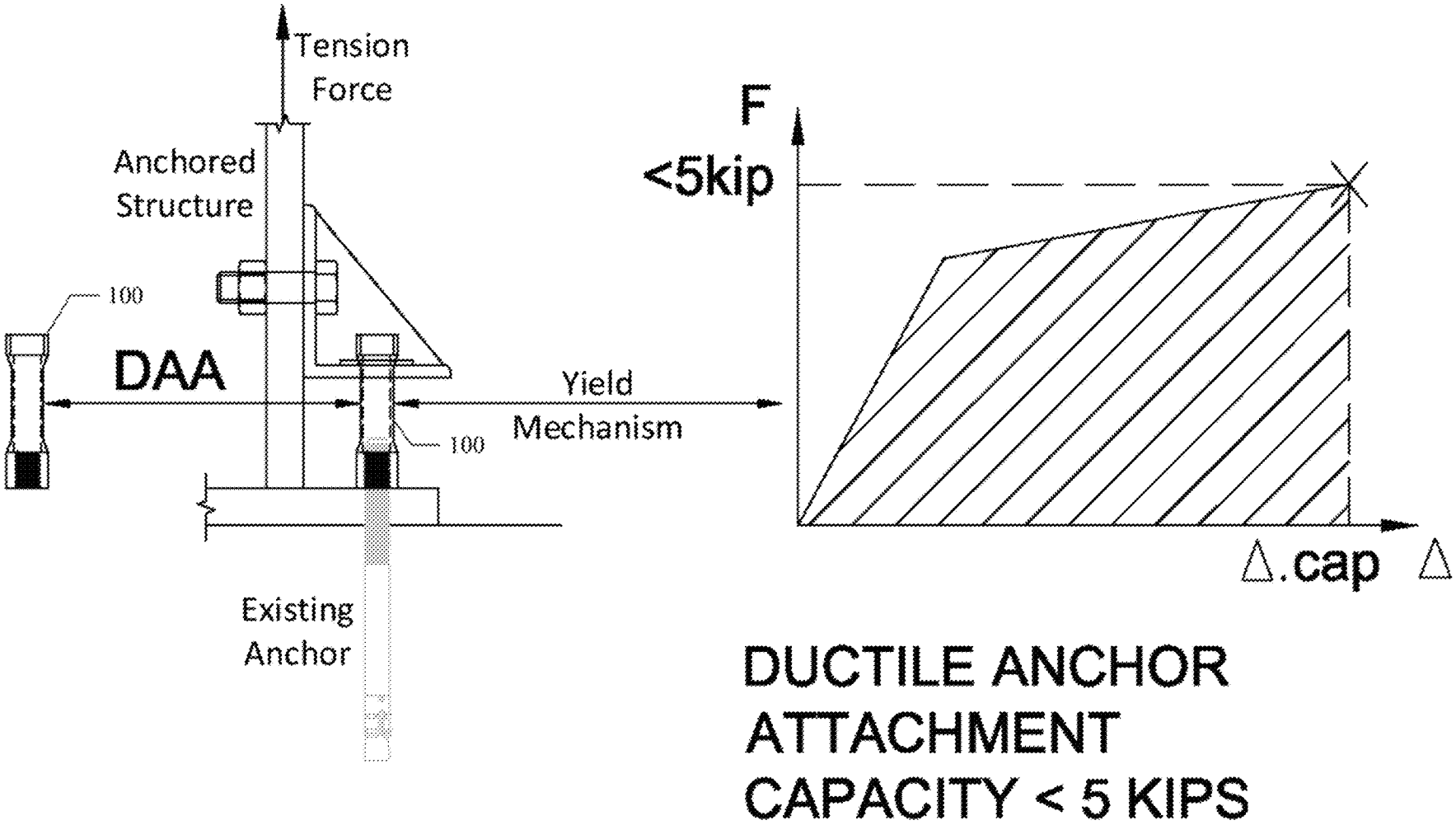
FIG. 3 illustrates an example embodiment of the DAA mechanism showing idealized force deflection performance of the post-installed DAA mechanism.

FIG. 3 illustrates an example embodiment of the DAA mechanism showing idealized force deflection performance of the post-installed DAA mechanism. The area under the curve shown in FIG. 3 represents work capacity of the system in terms of Joules. The DAA system as disclosed herein works; because, the DAA mechanism can deflect forces more extensively than the existing anchorage system. This allows the DAA mechanism to deform under a lower tension force than the existing anchor's capacity, thereby allowing the seismic (or other force-producing) event to be dissipated by the DAA mechanism without overloading the anchor.

Currently, conventional anchorage systems do not provide a ductile yield mechanism. One advantage of the DAA mechanism as disclosed herein is that the DAA mechanism can decrease the embedment depth of expansion anchors that must adhere to other codified requirements if a ductile attachment is not employed. In addition, the DAA mechanism is customizable to suit the needs of an existing or new anchorage system. For example, the neck of the DAA mechanism can be designed or calibrated to dissipate forces of the seismic or lateral force event at a pre-defined level while taking into consideration the capacity of the existing anchor.

Figure 5:
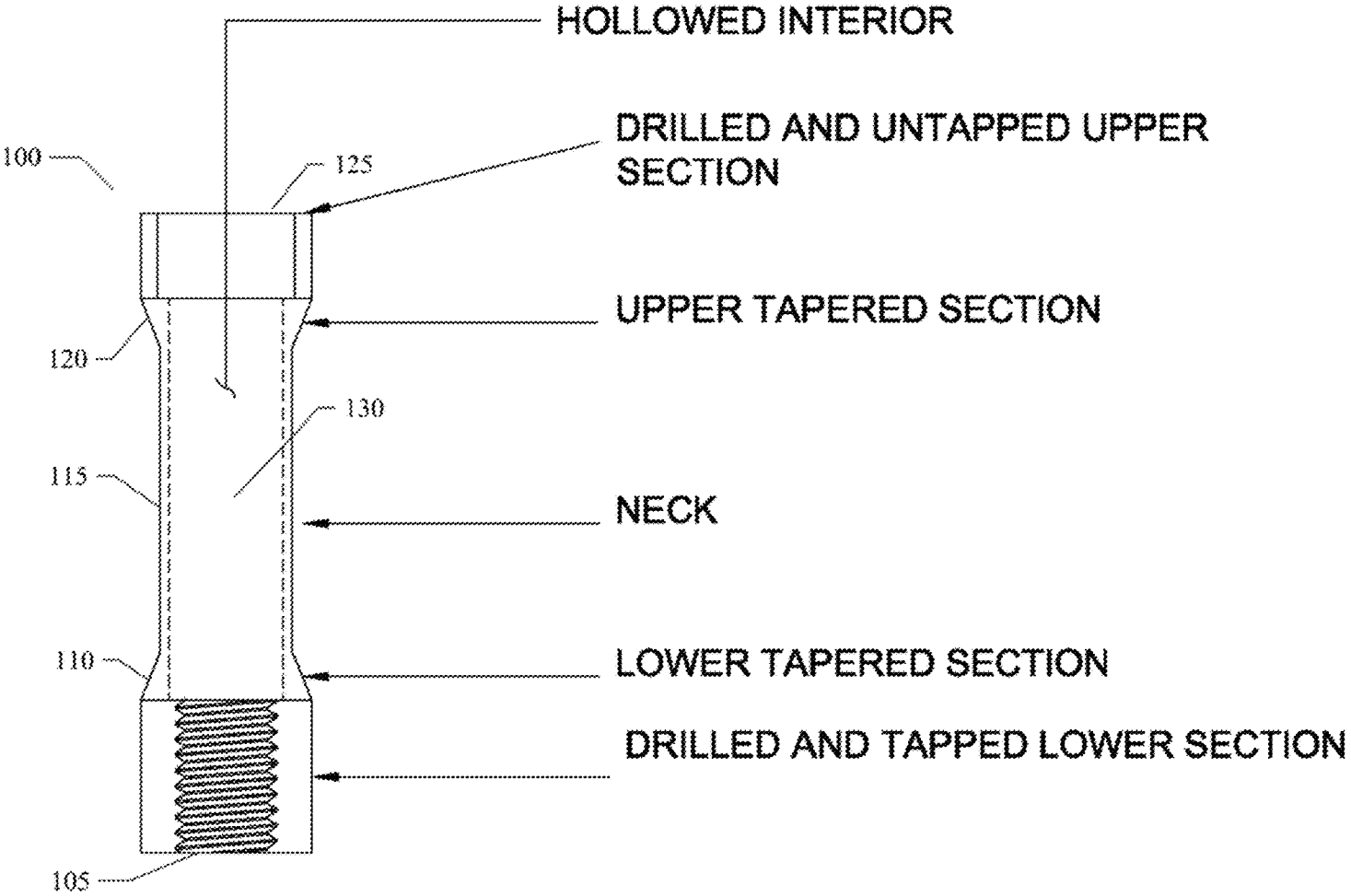
FIGS. 4 and 5 illustrate the components and fabrication of a DAA mechanism according to example embodiments.
Figure 4:
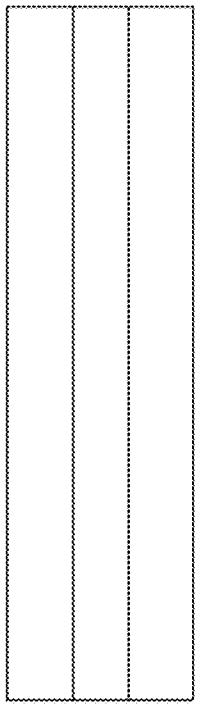

FIGS. 4 and 5 illustrate the components and fabrication of a DAA mechanism 100 according to example embodiments. In the DAA mechanism 100 according to an example embodiment shown in FIG. 5, the DAA mechanism 100 can include a drilled and tapped (threaded) bottom section 105 to allow the DAA mechanism 100 to connect to an existing anchor; a tapered lower section 110 to prevent the yield mechanism from forming near the threads of the bottom section 105; a narrowed neck 115 to allow the DAA mechanism 100 to form a configurable ductile yield mechanism; a tapered upper section 120 to prevent the yield mechanism from forming near the top section; a drilled and untapped (unthreaded) top section 125 to allow the DAA mechanism 100 to be engaged and pulled; and a hollowed interior 130 to allow for the DAA mechanism 100 to screw down into the supporting base regardless of anchor height. As shown in FIG. 4, an example embodiment of the DAA mechanism 100 can be fabricated from conventional pipe stock.

Figure 6:
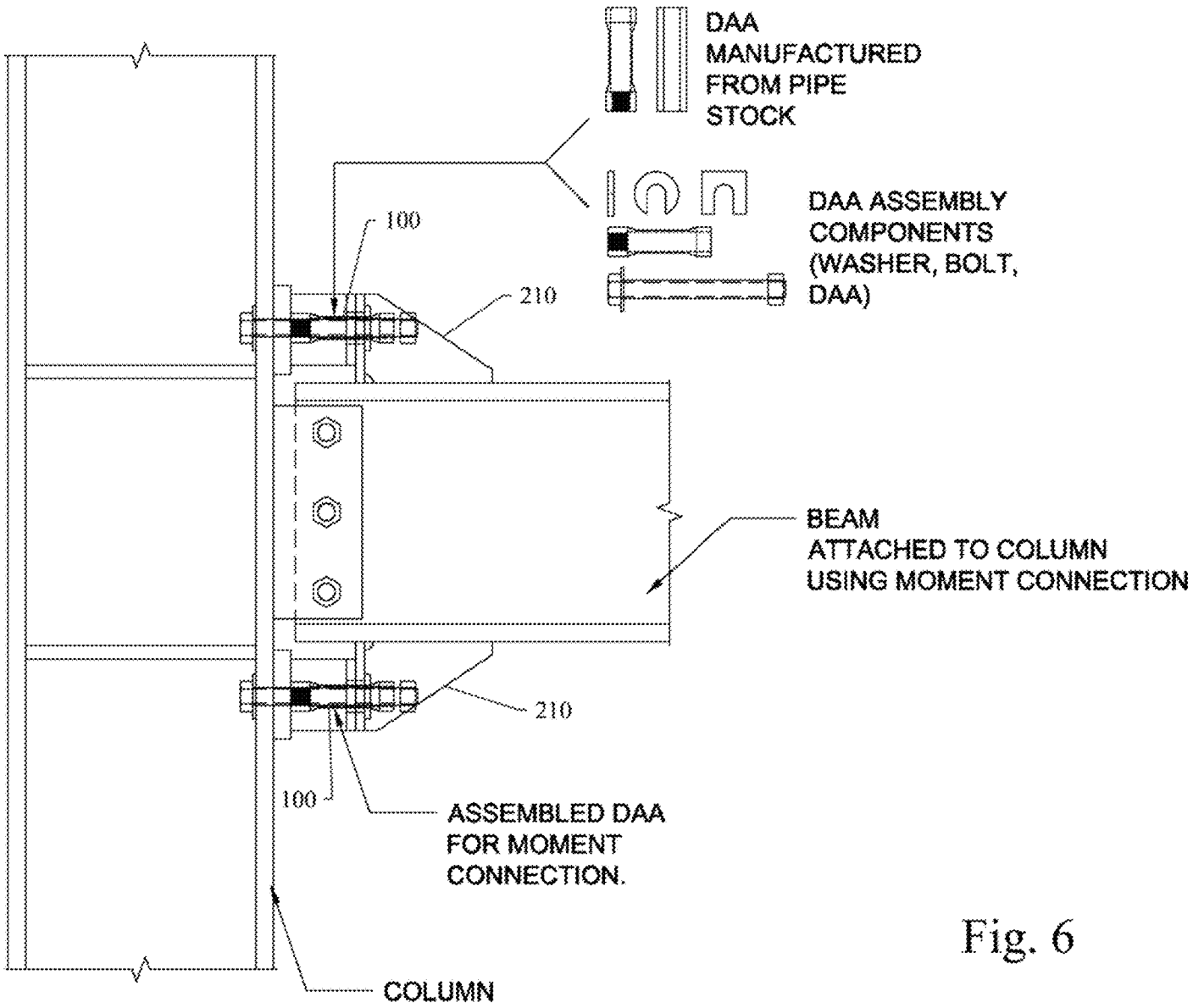
FIG. 6 illustrates an example embodiment of a DAA mechanism attached to an anchored structure.

Referring again to FIG. 2, the diagram illustrates an example embodiment of a DAA mechanism 100 of an example embodiment attached to an anchored structure. FIG. 6 illustrates another example embodiment of a DAA mechanism 100 attached to an anchored structure. FIGS. 2 and 6 illustrate the DAA mechanism 100 installed in a concrete anchorage system using a bracket 210 that connects the DAA mechanism 100 to the structure being anchored or a bolt and washers that connect the DAA mechanism 100 to a column and moment connection. In both example embodiments as illustrated, the DAA mechanism 100 is designed to be the fuse in the system that yields first in a seismic event or other force-producing event. Another example embodiment of the DAA mechanism 100 can be installed with a nut at the top to configurably control the amount of displacement that the DAA mechanism 100 can sustain. This ability to calibrate or configure the DAA mechanism 100 of various example embodiments allows designers to adjust or "dial in" the amount of force deflection the DAA system can experience. The DAA system is intended to not buckle in compression and only engage in tension forces.

Figure 7:
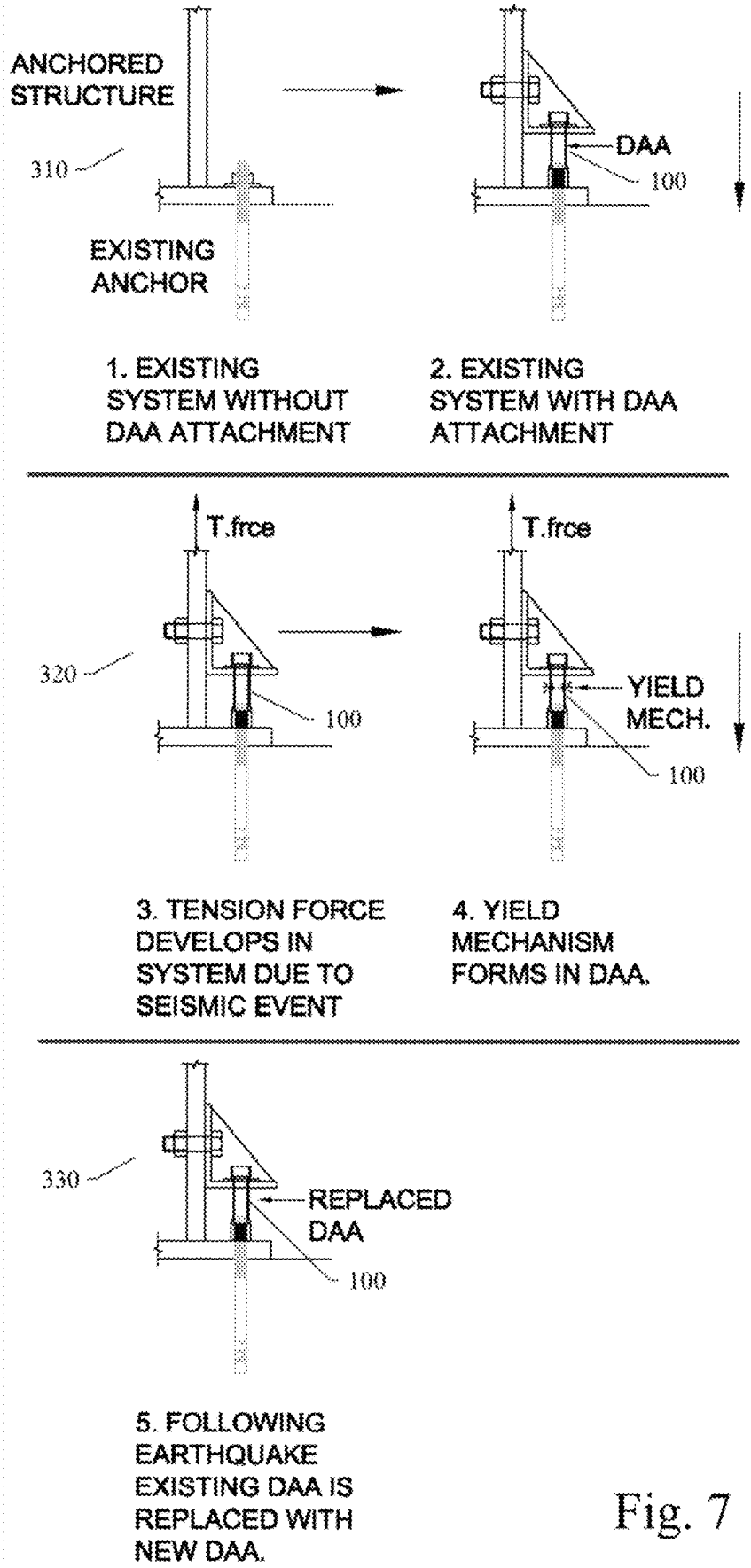
FIG. 7 illustrates a sample sequence of events in which the DAA mechanism of an example embodiment is intended to perform.

FIG. 7 illustrates a sample sequence of events in which the DAA mechanism 100 of an example embodiment is intended to perform. As shown in FIG. 7 at sequence event 310, the DAA mechanism 100 can be installed with or retrofit to an existing structural anchoring system. At sequence event 320, the structural anchoring system experiences tension force during a seismic event, for example. At a pre-defined and calibrated level of tension force, the DAA mechanism 100 undergoes a ductile yield while preserving the integrity of the remaining structural anchoring system. At sequence event 330, after the seismic or other event, the DAA mechanism 100 can be conveniently replaced without costly and extensive repairs to the existing structural anchoring system.

Figure 8:
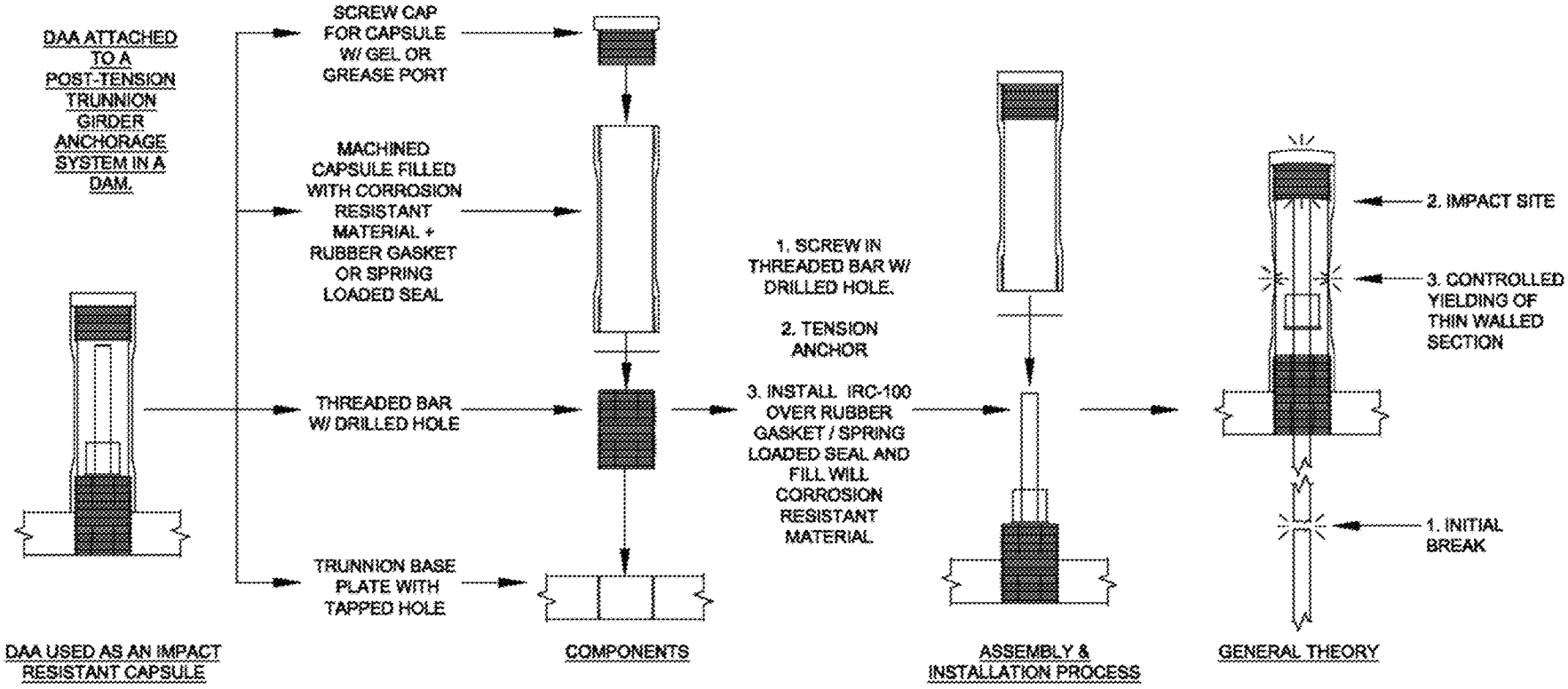
FIG. 8 illustrates another embodiment of a DAA mechanism as attached to a post-tension trunnion girder anchorage system.

FIG. 8 illustrates another embodiment of a DAA mechanism as attached to a post-tension trunnion girder anchorage system. In this embodiment, the DAA can be used as an impact resistant capsule. In an example of the use of the example embodiment, the DAA is attached to the ends of anchor heads in a post-tension trunnion girder. If an anchor fails, the anchor will impact the screw cap of the DAA. Following impact, the thin wall section of the capsule of the DAA will yield without damaging the bottom threads. Following incident, the DAA and anchor can be replaced.

As shown in FIG. 8, the components of the DAA of the example embodiment include a screw cap for the capsule with a gel or grease port, a machined capsule filled with corrosion resistant material, the capsule including a rubber gasket or spring loaded seal, a threaded bar with a drilled hole, and a trunnion base plate with a tapped hole.

The assembly of the components of the DAA of the example embodiment includes screwing the screw cap into the top of the capsule and screwing the threaded bar with a drilled hole into the trunnion base, tensioning the anchor, and installing the capsule over the rubber gasket or spring loaded seal and filling with a corrosion resistant material. As a result, the DAA of the example embodiment can be attached to a post-tension trunnion girder anchorage system where the DAA serves as an impact resistant capsule.

Lateral Force Resisting Example Embodiments

Referring now to FIGS. 9 through 14, example embodiments are illustrated that address lateral force resistance in addition to compression and tension forces. As described in more detail below, the DAA of example embodiments forms a plastic mechanism for a lateral force resisting system (plastic mechanism meaning the unique behavior of multiple anchors working together within a lateral force resist system or moment frame). This is a unique distinction as it requires a mechanism to form and not just the anchor to yield in compression or tension. In general, the DAA of example embodiments changes the system's fuse from the column to the jacketed rebar of the DAA. As described in more detail below, the DAA creates controlled ductile yielding within the fuse to respond to compression or tension forces. Additionally, the anchors in the concrete are intentionally oversized to force a plastic mechanism to occur in the fuse only. As a result, fixity is shifted to the center of a column base. The DAA system of the example embodiments as described below enable flexural forces transferred to the foundation to be adjusted up or down by designers, which offers greater design flexibility. Additionally, the disclosed DAA system is accessible to inspection and replacement, can be used on new or existing structures, and meets AISC and ACI requirements.

Figure 9:
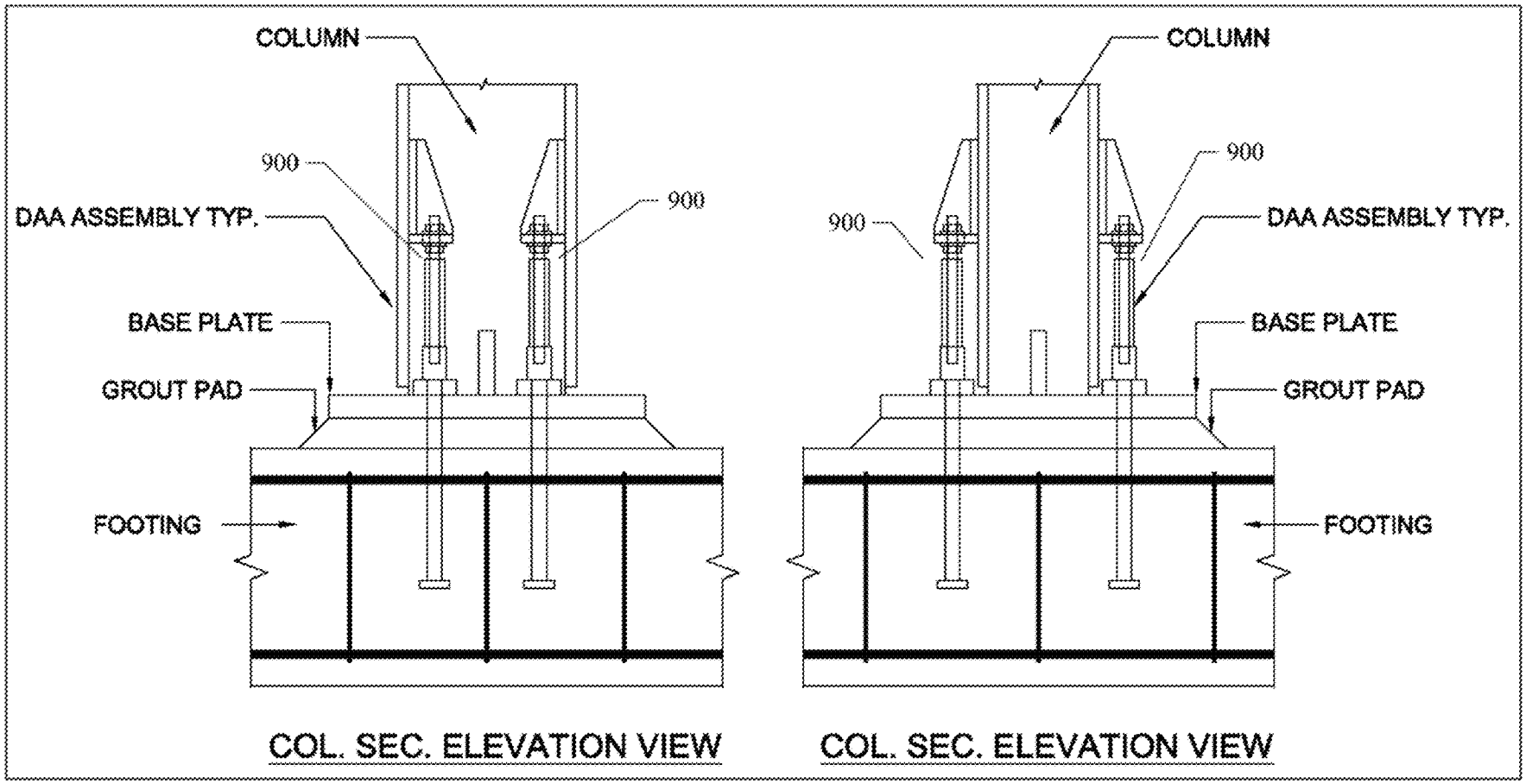
FIG. 9 illustrates an example embodiment of a DAA mechanism attached to column.
Figure 10:
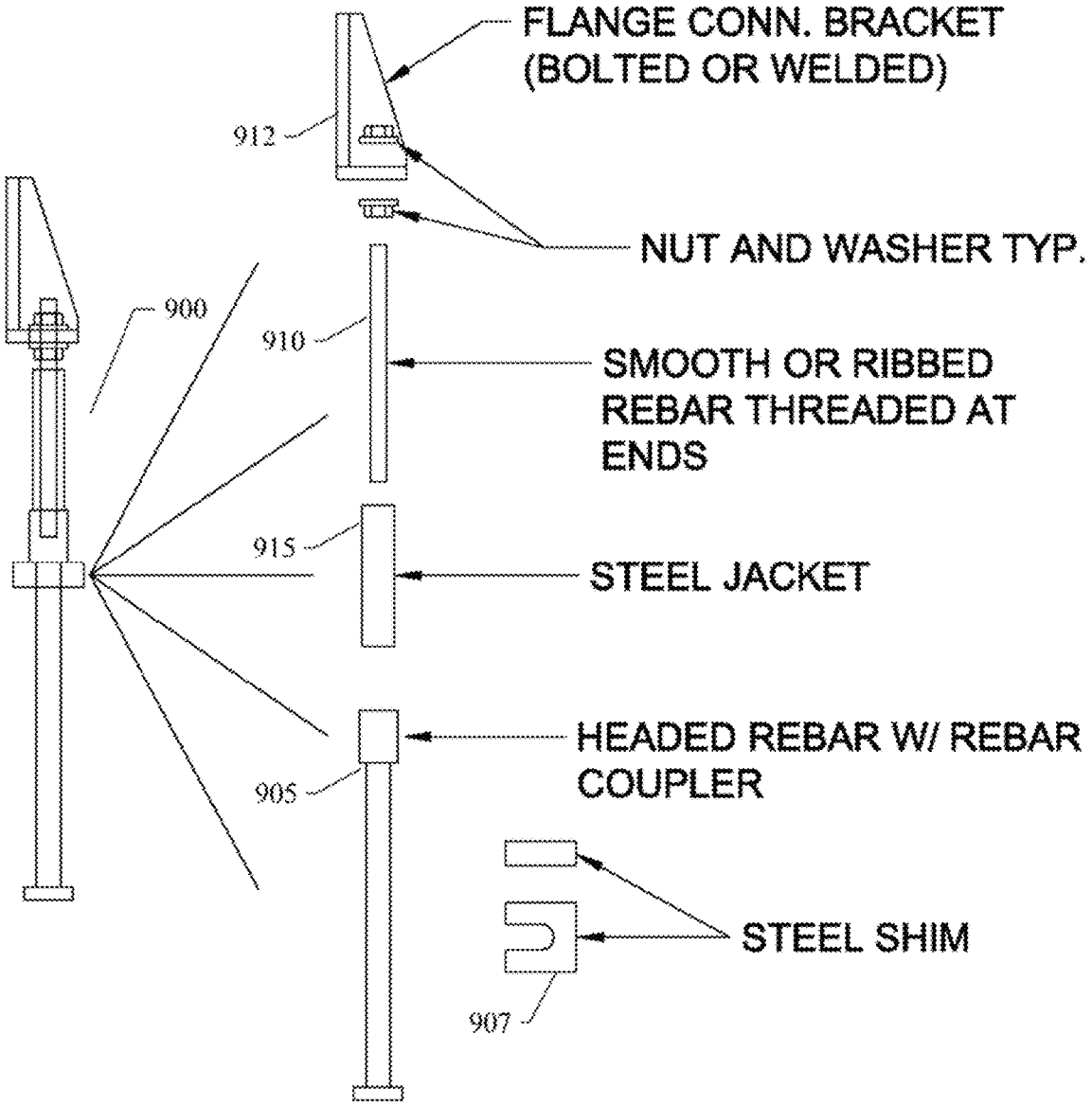
FIG. 10 illustrates the components and fabrication of a DAA mechanism according to example embodiments.

Referring now to FIGS. 9 and 10, the DAA system 900 of the illustrated example embodiment has replaced the tapered tubular neck of the DAA design described above with rebar segment 910 and metal (e.g., steel) jacket 915 components as shown in FIGS. 9-10. In particular, the ductile anchor attachment (DAA) mechanism 900 of an example embodiment comprises: a headed rebar with a rebar coupler 905; the rebar segment 910 coupled to the rebar coupler 905 at a first end of the rebar segment 910; the metal jacket 915 encasing at least a portion of the rebar segment 910; and a flange connection bracket 912 coupled to the rebar segment 910 at a second end of the rebar segment 910. The rebar segment 910 can be fabricated from conventional smooth or ribbed steel rebar. The DAA system 900 of the illustrated example embodiment can further include metal (e.g., steel) shims coupled with the headed rebar 905. The DAA system 900 can be configured so the rebar segment 910 is threaded at the second and coupled to the flange connection bracket 912 with a nut and washer.

Figure 11:
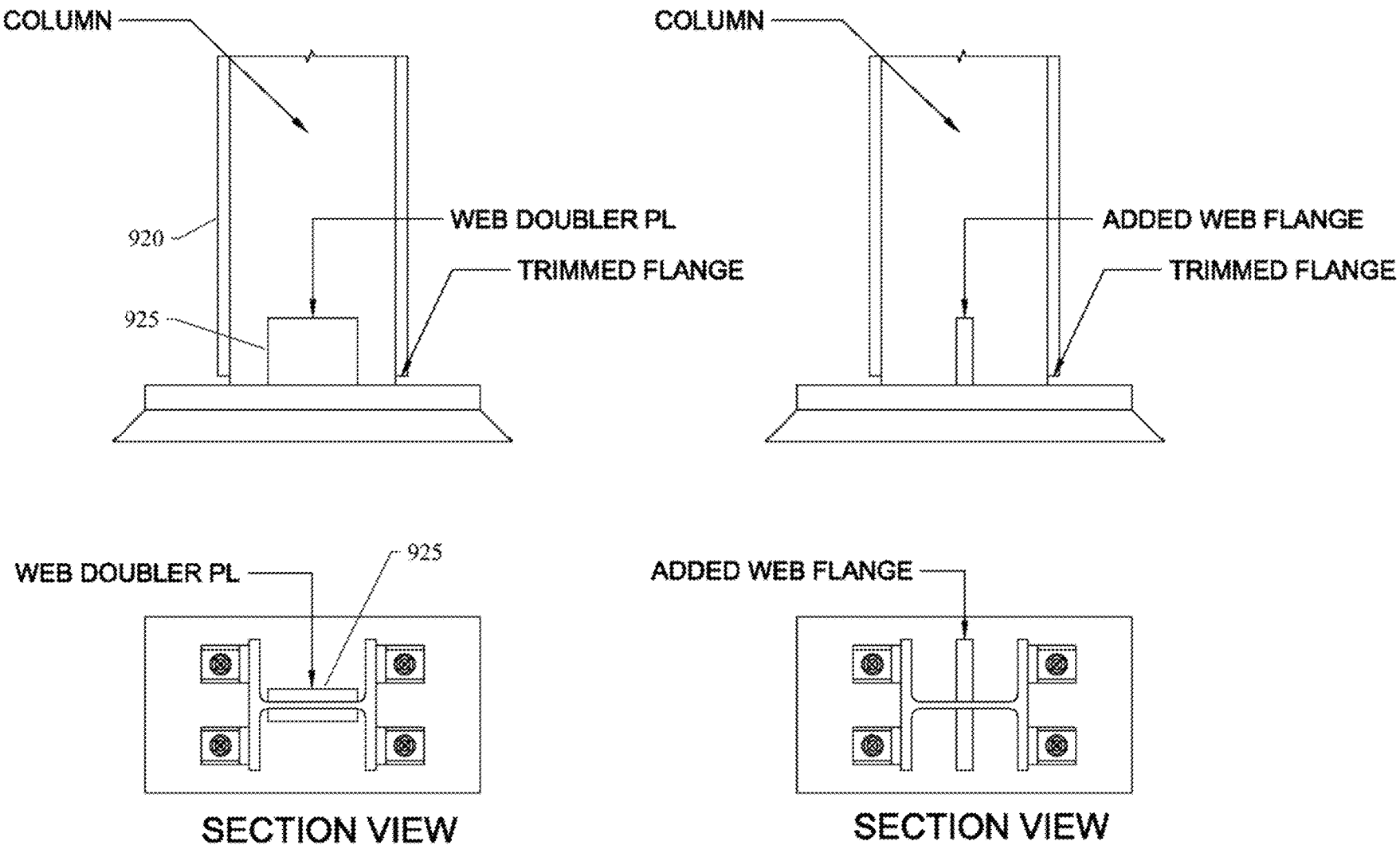
FIG. 11 illustrates an example embodiment of a DAA mechanism showing the trimmed flange and web doubler plate.

Referring to FIG. 11, the column flange 920 is trimmed to restrict plastic deformation to only occur in the DAA. Trimming the flange 920 will prevent or reduce compression or tension forces from occurring in the flange 920, thus removing the column's influence on the DAA system. Referring still to FIG. 11, a web doubler plate 925 or added flange of any shape can be used to improve axial capacity. Trimming the flanges 920 as described above can reduce the axial capacity of the steel column significantly. Using doubler plates 925 or flanges attached in the middle of the column, as shown in FIG. 11, can help recover the lost axial capacity. In addition, relocating the added steel area of the doubler plates 925 to the center of the column helps to mitigate the column's influence on the DAA system.

Figure 12:
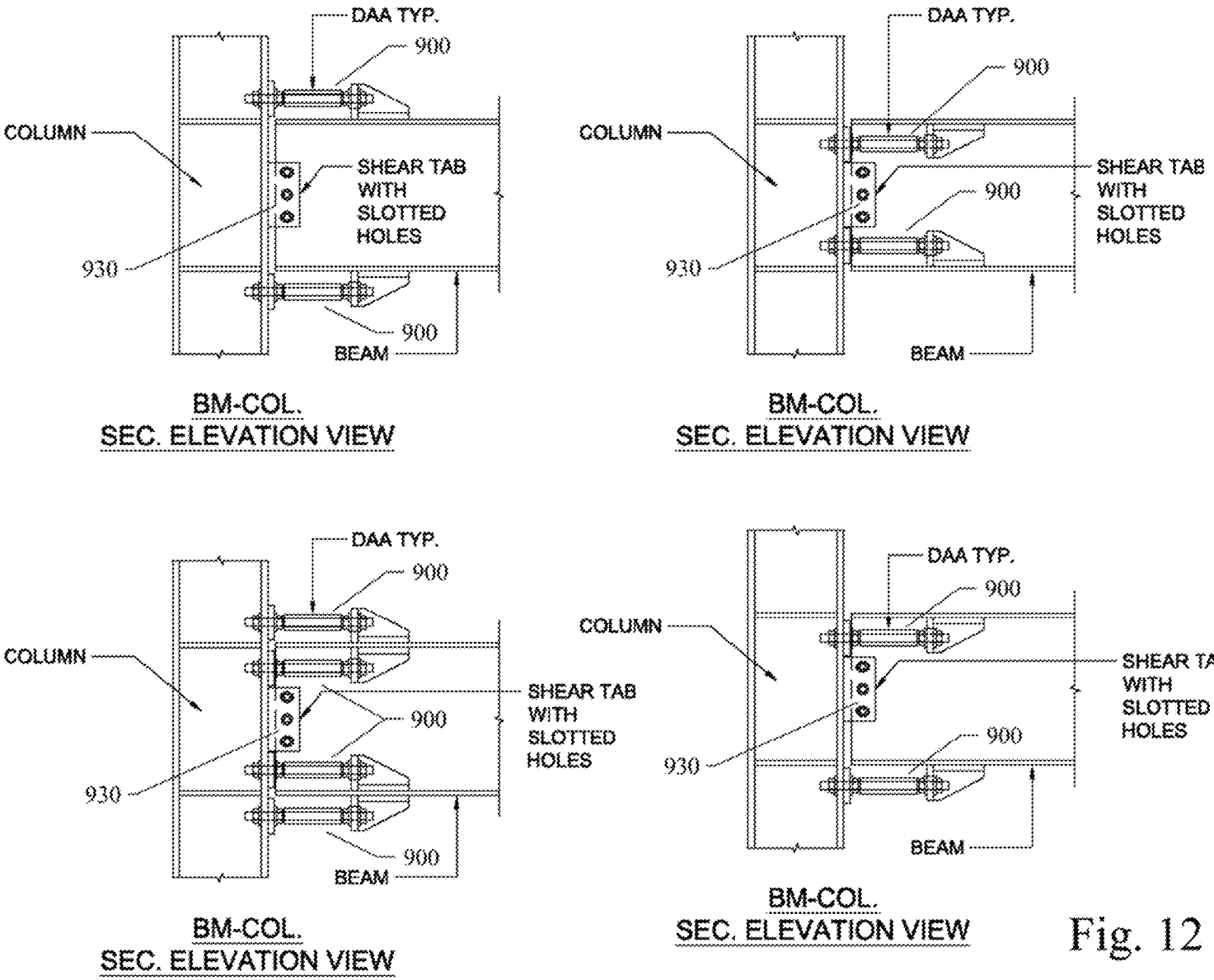
FIG. 12 illustrates an example embodiment of a DAA mechanism showing the shear tab with slotted holes.
Figure 13:
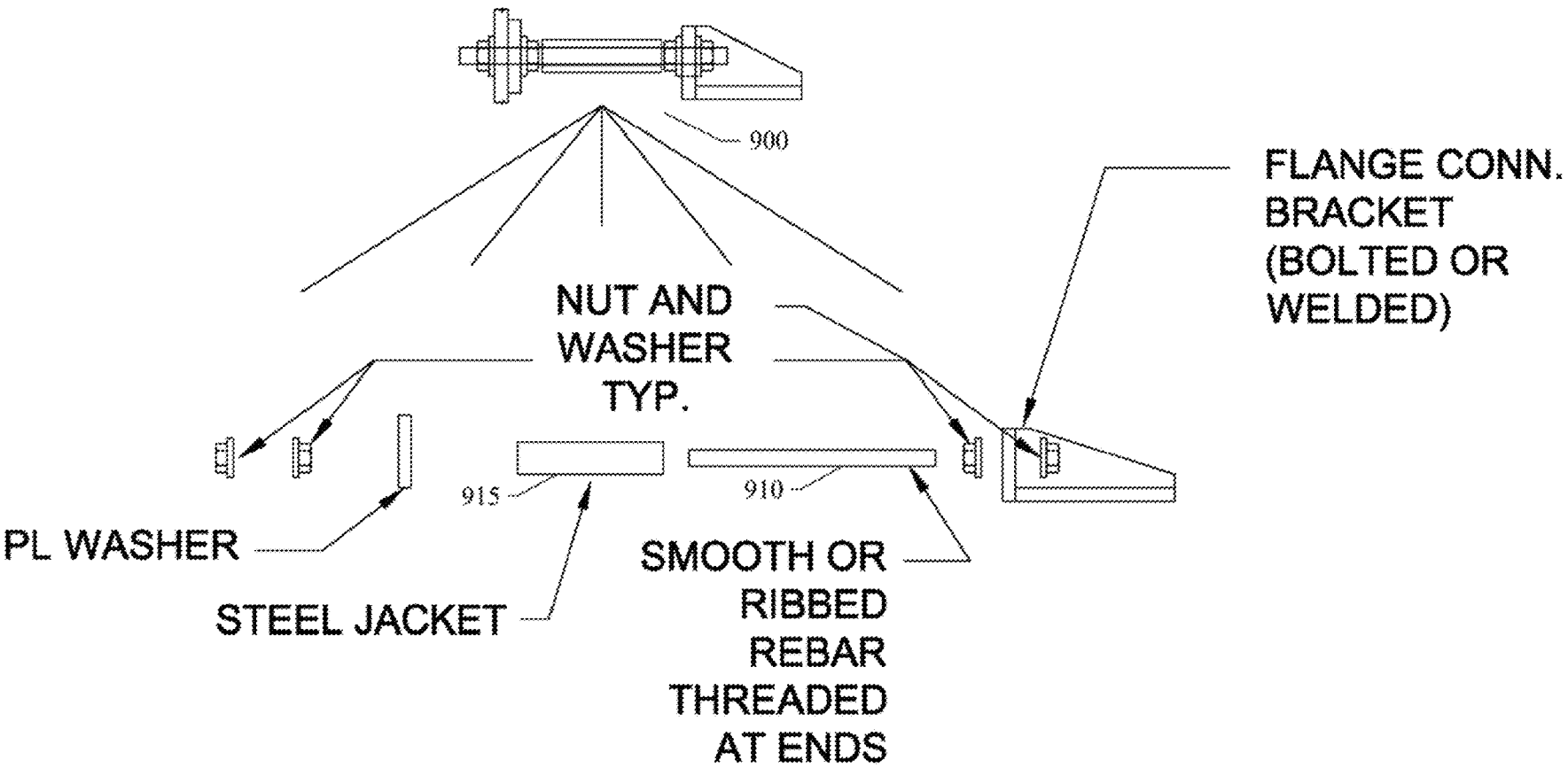
FIG. 13 illustrates the components and fabrication of a DAA mechanism according to example embodiments.
Figure 14:
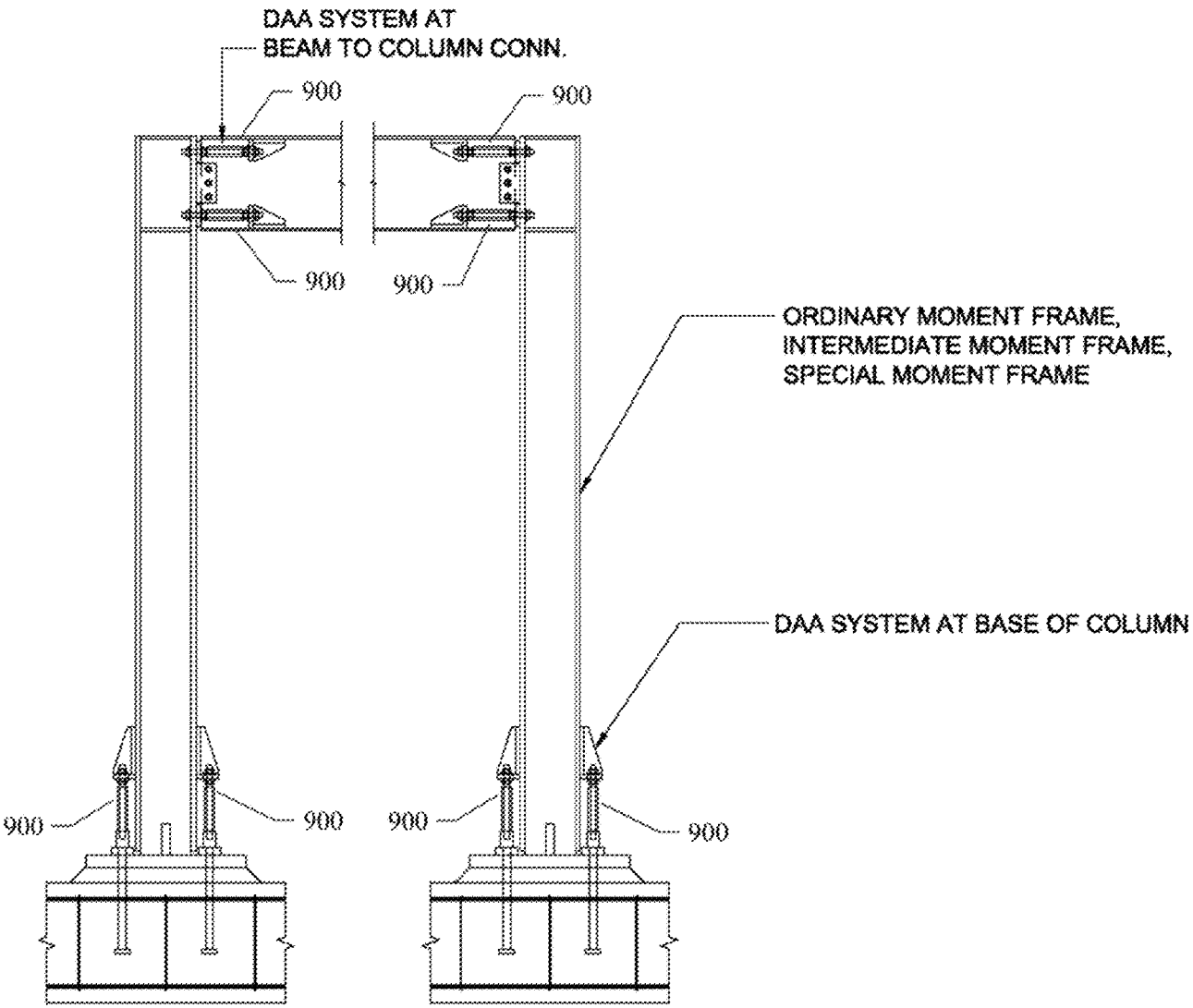
FIG. 14 illustrates an example embodiment of a DAA mechanism installed with a moment frame.

Referring now to FIG. 12, the DAA system of the illustrated example embodiment includes slotted holes in a shear tab 930 coupled between the column and the beam. Slotting the holes in the top and bottom of the shear tab 930 allows the system to rotate as the DAA forms a plastic mechanism/moment couple. The code requires for this connection to undergo a certain amount of rotation to be acceptable and to be considered prequalified. The slotted holes in the shear tab 930 of the example embodiment enable this rotation.

As illustrated in FIGS. 9 through 14 and described herein, the DAA system 900 of the illustrated example embodiments can include the rebar segment 910 and jacket 915 components, the trimmed flange 920, the web doubler plate 925 or added flange, and the slotted holes in a shear tab 930 to allow the DAA to be plastic while the rest of the system remains elastic. As a result, the DAA system of the disclosed example embodiments provides structural engineers with the ability to increase or decrease fixity at the base of a column that is part of a lateral force resisting system such as an Ordinary, Intermediate, or Special Moment frame. By creating variable fixity at the base of a column, engineers can limit force transfer into the footing and control building drift. In addition, the DAA system as disclosed herein enables the transfer of the weak link from the column and or foundation to the DAA to allow for easy replacement should yielding of the connection occur.

The DAA system as disclosed herein, through the use of multiple anchorages, allows the formation of a controlled plastic mechanism developed without negatively impacting a column, the column's foundation, or a beam. The disclosed DAA system can use multiple jacketed rebar (without a reduced cross section) to allow for the development of a plastic hinge or plastic mechanism to form with the governing failure modes being tension yielding or compression yielding. Currently there are no devices available that give structural engineers the following advantages in this manner:

Foundation fixity flexibility for moment frames
Beam connection fixity flexibility for moment frames
Limited force transfer to foundation
Limited force transfer to beam column connection
Limited force transfer to column
Damping of the moment frame system
Story drift control
Easy replacement
Adjustable controlled plastic mechanism formation of multiple DAAs The disclosed DAA system, compared to conventional systems, can be specific to a moment frame system versus a braced frame system. The DAA targets and provides flexibility at its connection points (e.g., beam to column and column to foundation) allowing engineers to increase or decrease fixity based on lateral demands, thus mitigating force transfer and drift issues of a building structure. The disclosed DAA system also works together with multiple localized DAA components to form a symmetrical and controlled plastic mechanism for a specific column or beam with limited influence from other structural elements of the building system or neighboring DAA systems in the same building system. The disclosed DAA system can also provide damping to the building, which will in turn decrease the building's stiffness and decrease force transfer into the building.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A ductile anchor attachment (DAA) system comprising:
a ductile anchor attachment (DAA) mechanism including:
a bottom section configured to connect to an existing anchor;
a tapered lower section;

a narrowed neck forming a ductile yield mechanism;
a tapered upper section;
a drilled top section;
a hollowed interior, wherein the DAA mechanism is fabricated from pipe stock; and a bracket for direct removable coupling of the DAA mechanism to a structure being anchored, the bracket being in contact with the tapered upper section of the DAA mechanism, the bracket being coupled to the upper section of the DAA mechanism with an adjustable attachment mechanism enabling configurable control of an amount of displacement that the DAA mechanism can sustain, the DAA mechanism in combination with the bracket being configured to not buckle under compression forces and to adjustably dissipate tension forces acting on the structure being anchored.

2. The DAA system of claim 1 wherein the bottom section is drilled and tapped.

3. The DAA system of claim 1 wherein the bracket includes perpendicular surfaces to removably couple the DAA mechanism to a column of the structure being anchored.

4. The DAA system of claim 1 being configured to undergo a ductile yield while preserving the integrity of a remaining structural anchoring system to which the DAA mechanism is attached.

5. The DAA system of claim 1 being configured to be conveniently replaced after a yield event without costly and extensive repairs to an existing structural anchoring system to which the DAA mechanism was attached.

6. The DAA system of claim 1 further including a screw cap for the top section with a gel or grease port.

7. A ductile anchor attachment (DAA) system comprising:

a ductile anchor attachment (DAA) mechanism including:

a bottom section configured to connect to an existing anchor;
a headed rebar with a rebar coupler;
a rebar segment coupled to the rebar coupler at a first end of the rebar segment;
a metal jacket encasing at least a portion of the rebar segment, the metal jacket not being in direct contact with a structure being anchored; and a bracket for direct removable coupling of the DAA mechanism to the structure being anchored, the bracket being in contact with the rebar segment of the DAA mechanism, the bracket being coupled to the upper section of the DAA mechanism with an adjustable attachment mechanism enabling configurable control an amount of displacement that the DAA mechanism can sustain, the DAA mechanism in combination with the bracket being configured to not buckle under compression forces and to adjustably dissipate tension forces acting on the structure being anchored.

8. The DAA system of claim 7 wherein the rebar segment is fabricated from smooth or ribbed steel rebar.

9. The DAA system of claim 7 further including metal shims coupled with the headed rebar.

10. The DAA system of claim 7 wherein the rebar segment is threaded at the second end and coupled to the bracket with a nut and washer.

11. The DAA system of claim 7 further including a trimmed column flange attached to an edge of a column to prevent or reduce compression or tension forces from occurring in the column.

12. The DAA system of claim 7 further including doubler plates or flanges attached in a middle of a column.

13. The DAA system of claim 7 further including a shear tab with slotted holes, the shear tab being coupled adjacent to the DAA and between a column and a beam.

14. The DAA system of claim 7 wherein the DAA is coupled at a base of a column thereby creating variable fixity at the base of the column.

15. The DAA system of claim 7 being further configured to transfer a weak link from a column or a foundation to the DAA.

16. The DAA system of claim 7 being configured to undergo a ductile yield while preserving the integrity of a remaining structural anchoring system to which the DAA is attached.

17. The DAA system of claim 7 being configured to be conveniently replaced after a yield event without costly and extensive repairs to an existing structural anchoring system to which the DAA was attached.

18. The DAA system of claim 7 being configured to enable the formation of a controlled plastic mechanism developed without negatively impacting a column, the column's foundation, or a beam.

19. The DAA system of claim 7 being configured for attachment to a moment frame.

* * * * *